US010280690B2

(12) United States Patent
Wilson et al.

(10) Patent No.: US 10,280,690 B2
(45) Date of Patent: May 7, 2019

(54) DRILL HEAD

(71) Applicant: TallyWalker Pty Ltd, Milton (AU)

(72) Inventors: Henry Albert Wilson, Cobar (AU); Nathan Brooks, Cobar (AU)

(73) Assignee: TallyWalker Pty Ltd, Milton (AU)

( * ) Notice: Subject to any disclaimer, the term of this patent is extended or adjusted under 35 U.S.C. 154(b) by 209 days.

(21) Appl. No.: 14/830,657

(22) Filed: Aug. 19, 2015

(65) Prior Publication Data

US 2016/0053550 A1 Feb. 25, 2016

(30) Foreign Application Priority Data

Aug. 20, 2014 (AU) ..... 2014903269

(51) Int. Cl.

| | |
|---|---|
| ***E21B 10/42*** | (2006.01) |
| ***E21B 17/18*** | (2006.01) |
| ***E21B 21/12*** | (2006.01) |
| ***E21B 10/60*** | (2006.01) |
| *E21B 4/14* | (2006.01) |
| *E21B 10/38* | (2006.01) |

(52) U.S. Cl.

CPC ..... *E21B 10/602* (2013.01); *E21B 10/42* (2013.01); *E21B 17/18* (2013.01); *E21B 21/12* (2013.01); *E21B 2010/607* (2013.01)

(58) Field of Classification Search

USPC ..... 175/296, 215, 292, 418

See application file for complete search history.

(56) References Cited

U.S. PATENT DOCUMENTS

| | | | | |
|---|---|---|---|---|
| 4,819,746 | A * | 4/1989 | Brown | E21B 4/14 175/215 |
| 5,407,021 | A * | 4/1995 | Kane | E21B 4/14 175/296 |
| 7,572,088 | B2 | 8/2009 | Biscay | |
| 2005/0025594 | A1 | 2/2005 | Lindblom | |
| 2009/0297285 | A1 * | 12/2009 | Nomura | B23B 41/02 408/59 |

FOREIGN PATENT DOCUMENTS

AU 2015215842 A1 3/2016

* cited by examiner

*Primary Examiner* — Matthew R Buck
*Assistant Examiner* — Douglas S Wood
(74) *Attorney, Agent, or Firm* — John W. Branch; Lowe Graham Jones PLLC

(57) ABSTRACT

A drill head including: an elongate housing, a first end of the housing being coupled to an end of a drill pipe in use; a base at a second end of the housing, one or more drill cutters being attached to the base; a supply passageway at least partially within the housing, the supply passageway being supplied with a flow of gas in use; a return passageway at least partially within the housing, a first end of the return passageway being connected to an end of an inner tube extending inside the drill pipe in use, and a second end of the return passageway forming an opening in the base proximate to the one or more drill cutters; and one or more ports for directing at least some of the flow of gas from the supply passageway into the return passageway in a flow direction extending away from the base and towards the inner tube, to thereby cause loose material to be drawn into the return passageway through the opening and transported away from the drill head via the inner tube in use.

20 Claims, 5 Drawing Sheets

DRILL HEAD

BACKGROUND OF THE INVENTION

The present invention relates to a drill head, being particularly suitable for exploration drilling operations in which rock chip samples are collected.

DESCRIPTION OF THE PRIOR ART

A range of drilling techniques is known for forming holes in the ground, passing through rock or the like. Exploration drilling operations are carried out in the mining and resources industries to obtain information about the composition of the ground beneath the surface, such as to identify deposits of minerals or other desirable substances within the rock.

In general, exploration drilling will utilise drilling rigs having particular adaptations for allowing rock chip samples to be collected and returned to the surface from the cutting face at the bottom of the hole. Techniques for returning the samples to the surface by supplying compressed air down the hole are collectively referred to as air drilling. In most air drilling techniques, the drilling rig will include a drill head which provides an interface between one or more drill cutters which cut the rock and at least a drill rod which extends down the hole from the surface. The drill head will typically be configured to direct the flow of compressed air and transfer loads as the drill cutters driven through the rock.

Rotary air blast drilling is a simple form of air drilling which involves supplying compressed air down the hole through a hollow drill rod. The compressed air blows the rock chips up to the surface in the space between the drill rod and the sidewall of the hole. However, rotary air blast drilling is not desirable for deep drilling operations because there will be significant contamination of the rock chips from the cutting surface as these come into contact with the sidewall rock in higher parts of the hole.

Air core drilling is more often employed in deep drilling operations to allow for reduced contamination of the rock samples. This technique will usually operate using a rotary drilling mechanism, with rotary drill cutters mounted on a lower end of the drill head and an upper end of the drill head being connected to a drill rod which is rotated to drive the drill cutters through the rock. The drill rod is hollow and an inner tube extends inside the drill rod. Compressed air is injected into the hole via an annular area between the drill rod and the inner tube. The drill head will typically have ports for directing the compressed to the bottom of the hole around the cutting surface, and further provide an opening for allowing rock cuttings to be blown up the inner tube due to the compressed air.

Reverse circulation drilling is similar to air core drilling but utilises a pneumatic reciprocating piston arrangement known as a hammer to drive the drill cutters, rather than rotating of the drill rod and the drill head. This drilling mechanism can provide for better penetration of hard rock, and also removes the need for rotation of the drill tube to drive the drill cutters. Despite the use of a different drilling mechanism, a flow of compressed air is nevertheless supplied to the bottom of the hole in a similar manner as discussed above, to force rock chip samples up an inner tube, by providing a suitably configured drill head. Water may also be used to assist in pushing the cutting back up the inner tube.

Air core and reverse circulation drilling techniques may require a seal in the form of a collar or the like to be provided in the hole around the drill head to prevent samples from being blown between upwardly between the sidewall of the hole and the drill rod. Even with such a seal, there will still usually be some contamination between the rock cuttings from the cutting surface and cuttings from higher layers in the hole, due to the forceful supply of compressed air into the bottom of the hole.

Furthermore, existing air drilling techniques often result in relatively small rock chip samples being collected. This may be due to the flow of compressed air being inadequate to blow larger rock chips from the cutting face and/or due to these being broken into smaller rock chips as these are blown past the drill cutters.

The reference in this specification to any prior publication (or information derived from it), or to any matter which is known, is not, and should not be taken as an acknowledgment or admission or any form of suggestion that the prior publication (or information derived from it) or known matter forms part of the common general knowledge in the field of endeavour to which this specification relates.

SUMMARY OF THE PRESENT INVENTION

In a broad form the present invention seeks to provide a drill head including:

a) an elongate housing, a first end of the housing being coupled to an end of a drill pipe in use;
b) a base at a second end of the housing, one or more drill cutters being attached to the base;
c) a supply passageway at least partially within the housing, the supply passageway being supplied with a flow of gas in use;
d) a return passageway at least partially within the housing, a first end of the return passageway being connected to an end of an inner tube extending inside the drill pipe in use, and a second end of the return passageway forming an opening in the base proximate to the one or more drill cutters; and,
e) one or more ports for directing at least some of the flow of gas from the supply passageway into the return passageway in a flow direction extending away from the base and towards the inner tube, to thereby cause loose material to be drawn into the return passageway through the opening and transported away from the drill head via the inner tube in use.

Typically the at least some of the flow of gas directed into the return passageway by the one or more ports generates a gas pressure difference between the opening and the return passageway, to thereby cause loose material to be drawn into the return passageway through the opening.

Typically the supply passageway defines a supply cross section area and the return passageway defines a return cross section area, the supply cross section area being greater than the return cross section area.

Typically the one or more ports are configured so that the at least some of the flow of gas directed into the return passageway includes an axial flow component relative to an axis of the return passageway.

Typically the one or more ports are configured so that the at least some of the flow of gas directed into the return passageway further includes an rotational flow component relative to the axis of the return passageway.

Typically the one or more ports are oriented at an angle relative to the axis of the return passageway.

Typically the one or more ports are configured so that the at least some of the flow of gas directed into the return passageway forms a vortical flow in at least a portion of the return passageway.

Typically the drill head includes a plurality of the ports arranged around the return passageway.

Typically the drill head includes one or more holes through the base for allowing some of the flow of gas to pass from the supply passageway to a region proximate to the one or more drill cutters.

Typically the drill head includes a plurality of the holes arranged around the opening in the base Typically the housing has a generally cylindrical shape and the return passageway is located coaxially inside the housing.

Typically the supply passageway is located between the return passageway and an outside surface of the housing.

Typically the supply passageway is provided as an annular passageway, the return passageway being located concentrically inside the annular supply passageway.

Typically the drill head includes a hollow outer housing and an inner housing positioned inside the outer housing, the return passageway being defined within the inner housing and the supply passageway being defined between the inner housing and the outer housing.

Typically the outer housing is provided by an outer housing component and the inner housing is provided by an inner housing component.

Typically the inner housing component includes one or more spacers for locating the inner housing component relative to the outer housing component.

Typically the one or more ports are provided in a port component connected to an end of the inner housing component.

Typically the port component is configured to be connected between the inner housing component and the base.

Typically the port component includes a central aperture for extending the return passageway in the inner housing component to the opening in the base.

Typically the base is provided by a base component connected to an end of the outer housing component, the base component including the opening and being configured to allow the attachment of the one or more drill cutters.

BRIEF DESCRIPTION OF THE DRAWINGS

An example of the present invention will now be described with reference to the accompanying drawings, in which:—

DETAILED DESCRIPTION OF THE PREFERRED EMBODIMENTS

An example embodiment of a drill head 100 will now be described with reference to FIGS. 1A to 1F and FIG. 2 which illustrates an example of the drill head 100 in use.

Figure 2:
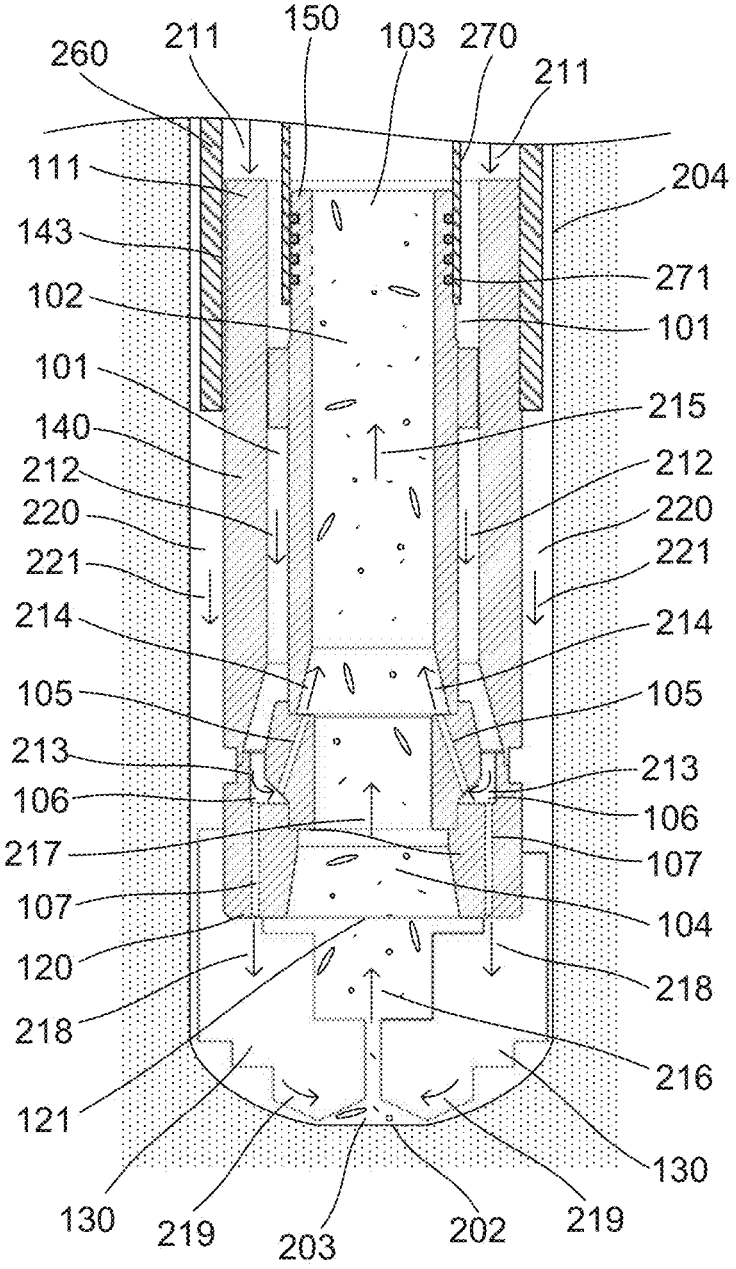
FIG. 2 is a cross section view showing the drill head of FIG. 1A in use.

The drill head 100 includes an elongate housing 110. As shown in FIG. 2, a first end 111 of the housing 110 is coupled to an end of a drill pipe 260 in use. The drill head 100 also includes a base 120 at a second end 112 of the housing 111, and one or more drill cutters 130 are attached to the base 120.

It should be noted that a range of different styles of drill cutters 130 may be used with the drill head 100 without significantly impacting the above described functionality, and as such it should be appreciated that the particular drill cutters 130 depicted in FIGS. 1A to 1D and FIG. 2 are for the purpose of enabling understanding of the invention but are not intended to limit the type of drill cutters 130 that can be used.

In this example, the drill head 100 is used in a rotary drilling arrangement, such that when the drill pipe 260 is rotationally driven this will cause the drill cutters 130 to rotate and cut into material 201 such as rock at a cutting face 202 to thereby drill a hole in the material 201, in a generally conventional manner. Accordingly, the drill cutters 130 shown in the Figures are rotary drill cutters particularly adapted for rotary drilling.

However, alternative embodiments of the drill head 100 may be used in other drilling arrangements and may thus use different forms of drill cutters 130, such as for hammer drilling where the drill cutters 130 are periodically driven by a pneumatic motor to cut into the material 201, rather than through rotation of the drill pipe 260.

Figure 1C:
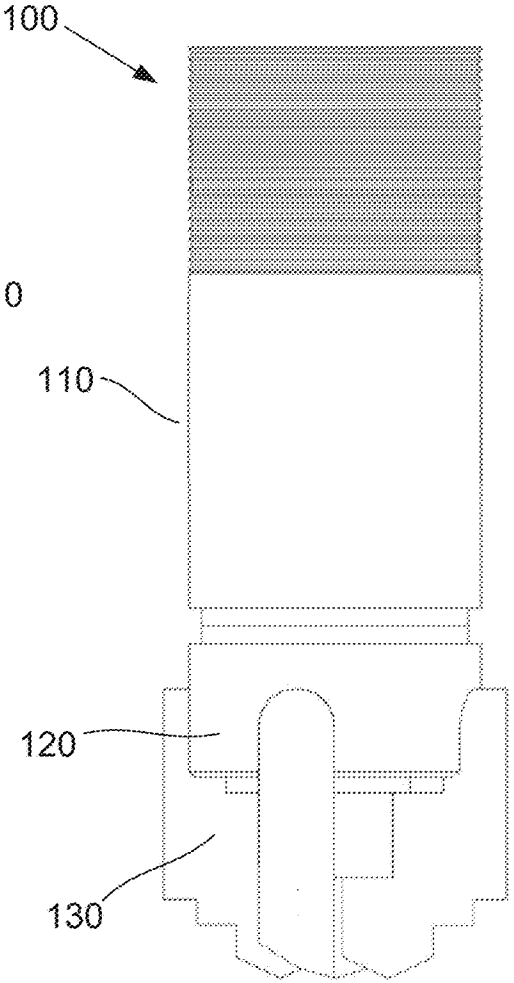
FIG. 1C is a side view of the drill head of FIG. 1A.
Figure 1B:
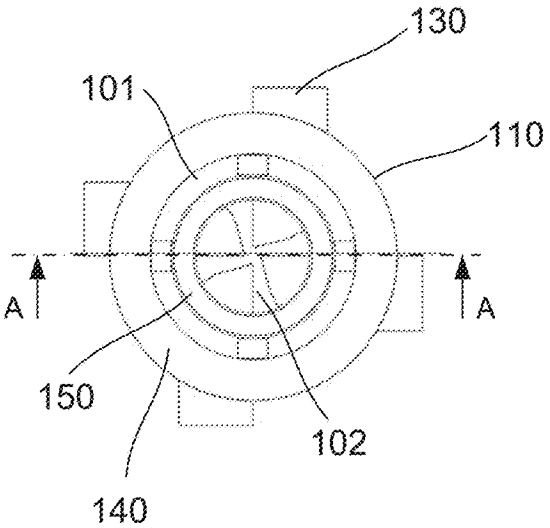
FIG. 1B is an end view of the drill head of FIG. 1A.
Figure 1A:
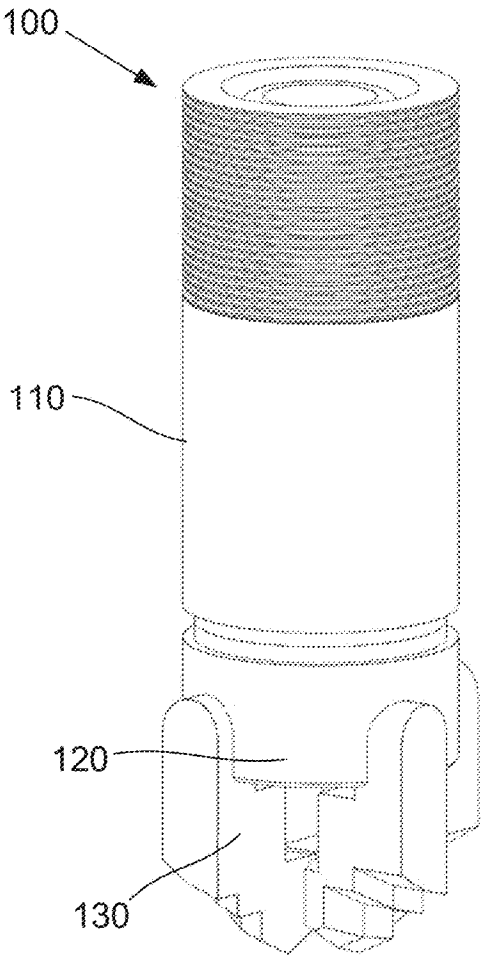
FIG. 1A is a perspective view of an example of a drill head.
Figure 1F:
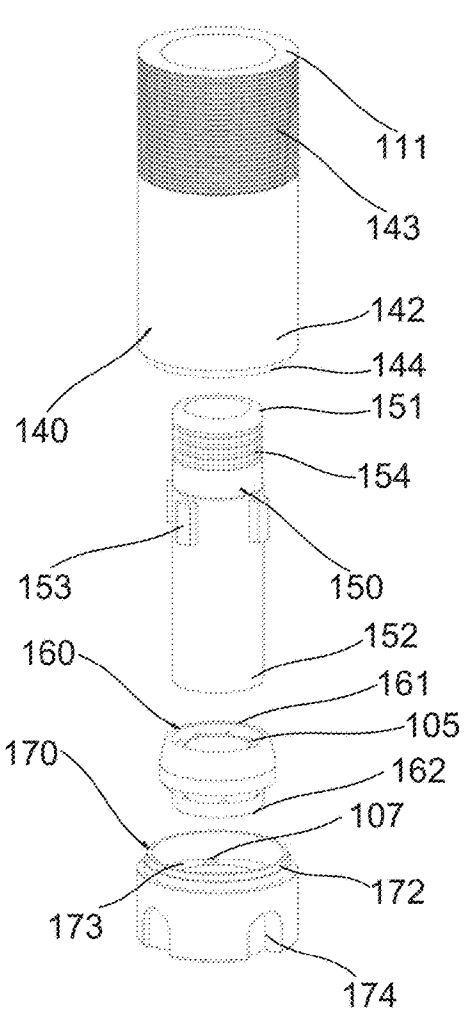
FIG. 1F is an exploded perspective view of components for forming the drill head of FIG. 1A, without drill cutters.
Figure 1E:
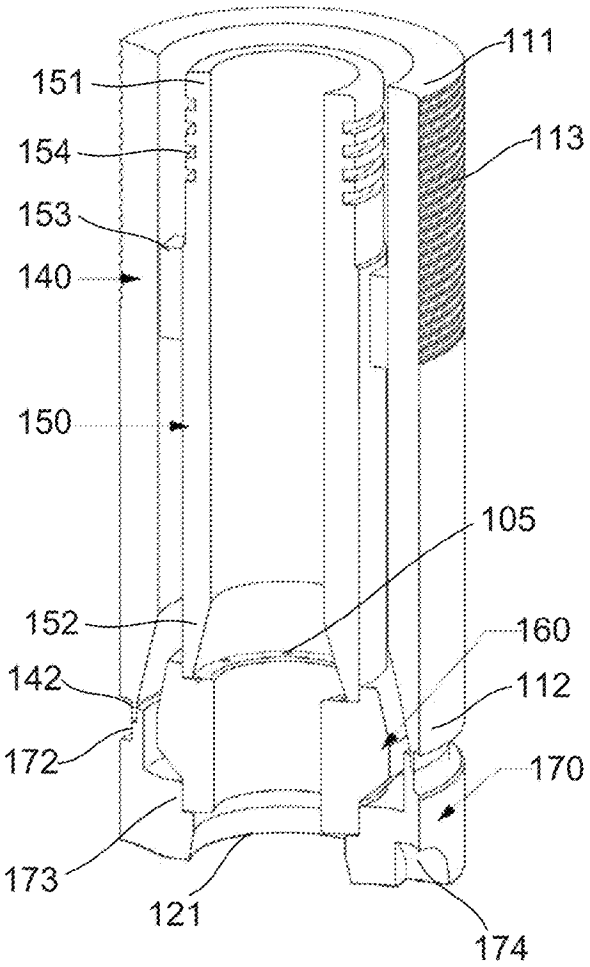
FIG. 1E is a perspective cross-section view of the drill head at section A-A of FIG. 1B, without drill cutters.
Figure 1D:
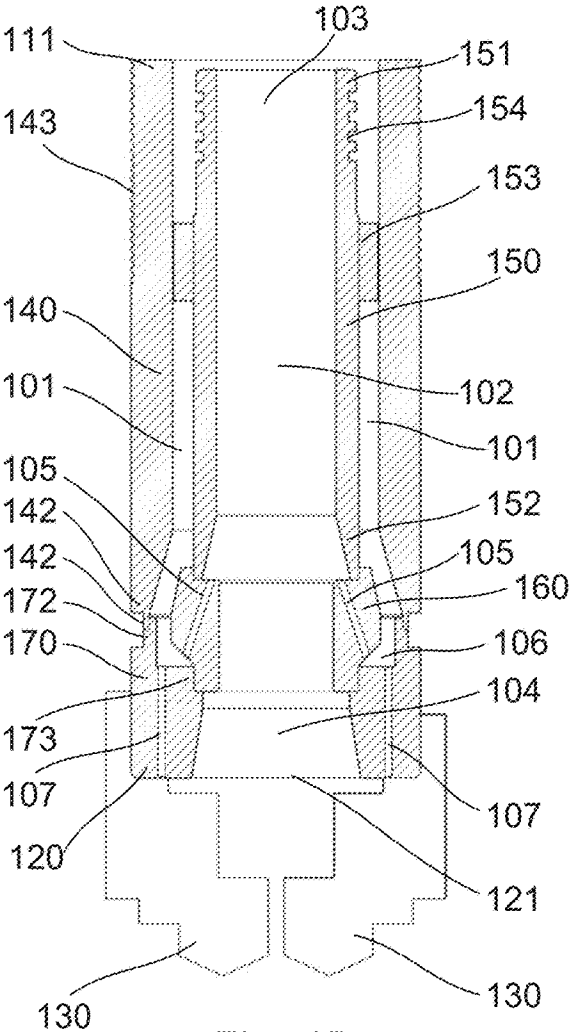
FIG. 1D is a side cross-section view of the drill head at section A-A of FIG. 1B.

With regard to the cross section views of FIGS. 1D and 1E, the drill head 100 includes a supply passageway 101 at least partially within the housing 110. The supply passageway 101 is supplied with a flow of gas in use. For example, with reference to FIG. 2, arrows 211 indicate a flow of gas being supplied to the supply passageway 101 from a corresponding passageway inside the drill pipe 260 and arrows 212 indicate the flow of gas through the supply passageway 101 itself.

The flow of gas may be provided, for example, by a compressed gas source (not shown) at the surface. Typically, the compressed gas source will be an air compressor or the like for compressing atmospheric air from the surface. Although air is readily available and easily compressible, it should be understood that any suitable gas may be used. In any event, the compressed gas source would typically be connected to the drill pipe 260 at the surface to supply compressed gas into the drill pipe 260 to in turn supply the flow of gas to the supply passageway 101.

The drill head 100 further includes a return passageway 102 at least partially within the housing 110. A first end 103 of the return passageway 102 is connected to an end of an inner tube 270 extending inside the drill pipe 260, whilst a second end 104 of the return passageway 102 forms an opening 121 in the base 120 proximate to the drill cutters 130. The inner tube 270 will typically extend inside the drill pipe 260 to the surface to provide a continuous path from the return passageway 102 to the surface via the inner tube 270.

One or more ports 105 are provided for directing at least some of the flow of gas from the supply passageway 101 into the return passageway 102, in a flow direction extending away from the base 120 and towards the inner tube 270. For example, with reference again to FIG. 2, arrows 213 indicate flows of gas entering the ports 105 from the supply passageway 101, whilst arrows 214 indicate flows of gas exiting the ports 105 into the return passageway 102. It is noted that this results in a flow of gas through the return passageway 102 and into the inner tube 270 as indicated by arrow 215.

The flow of gas through the ports 105 causes loose material 203, such as drill chips in the form of chips of rock or the like cut by the drill cutters 130 at the cutting face 202, to be drawn into the return passageway 102 through the opening 121 and transported away from the drill head 100 via the inner tube 270. For example, with reference to FIG. 2, arrow 216 indicates a flow of gas which draws loose material 203 from the cutting face 202 into the opening 121 in the base 120, and arrow 217 indicates a flow of gas with entrained loose material 203 passing into the return passageway 102 due to the flow of gas from the ports 160 as indicated by arrows 213 and 214.

It will be appreciated that loose material 203 entrained in the flow of gas through the return passageway 102 will subsequently pass through the inner tube 270 and thus may be transported to the surface via the inner tube 270. Thus, samples of rock chips or the like may be transported from the cutting face 202 to the surface for collection.

It will be understood that the loose material 203 may be drawn upwardly from the cutting face 202 towards the opening 121, and subsequently into the return passageway 102 and the inner tube 270, under the influence of different physical effects, such as by generating a partial vacuum to move loose material by suction or by causing an additional flow of gas to flow supplied to the cutting face 202 to flow into the opening 121 with entrained loose material 203.

For example, the loose material 203 may be drawn into the opening 121 due to suction caused by the flow of gas through the ports 105 into the return passageway 102. In preferred implementations, the flow of gas directed into the return passageway 102 by the ports 105 will generate a gas pressure difference between the opening 121 and the return passageway 102, to thereby cause the loose material to be drawn into the return passageway 102 through the opening 121 due to suction. However, it should be understood that this gas pressure difference can be due to different mechanisms depending on the particular design configuration, as will be discussed in further detail below.

In any event, the above described arrangement can be contrasted from conventional air drilling techniques in that at least some of the flow of air is directed into the return passageway 102 via the ports 105, so that at least some of the supplied flow is diverted back towards the surface via the inner tube 270 without passing through the region proximate to the drill cutters 130 or cutting face 202. In general, this diverted flow causes loose material 203 to be drawn into the opening 121 by suction rather than by directly blowing loose material 203 from the cutting face 202 as is generally the case in conventional air drilling techniques. In this regard is noted that conventional air drilling techniques usually direct all of the supplied flow of gas through holes arranged around the drill cutters so that the gas flows across the cutting surface and subsequently blows the loose material back to the surface, either through an inner tube extending inside the drill rod or in the space surrounding the drill rod.

In contrast to conventional air drilling techniques, the above described arrangement allows for improved quality of rock chip samples, because the suction mechanism of collecting rock chip samples from the cutting face 202 is less prone to contamination compared to forcefully blowing the cutting face 202 with gas.

Furthermore, loose material 203 can be removed from the cutting face 202 more efficiently due to the loose material being drawn into the opening 121, in comparison to conventional air drilling techniques in which forcefully supplying gas to the cutting face 202 does not reliably blow loose material directly into the inner tube and can undesirably blow some loose material into the space outside the drill rod or otherwise induce circulation of loose material about the drill cutters.

In addition, the drill head 100 as described above may allow for the collection of larger rock chip samples than in similar conventional air drilling techniques, because the rock chips are less likely to be broken into smaller chips by the drill cutters when they are more efficiently drawn away from the cutting face 202.

In view of the above advantages, it has been found that the above described arrangement can allow for significant productivity improvements for exploratory drilling operation, when compared to the use of conventional air drilling techniques employed to delivery rock chip samples with similar quality and size parameters.

As will be understood by persons skilled in the art, the improved functionality of the above described arrangement is at least in part due to the arrangement of the passageways 101, 102, ports 105 and the opening 121 defined within the housing 110 and the base 120, to provide the flow of gas that draws loose material 203 from the cutting face 202 into the drill head 100 and transports it to the surface via the inner tube 170.

It should therefore be appreciated that embodiments of the drill head 100 may be provided with different structural configurations whilst still providing the above discussed functionality, as long as these provide suitable passageways 101, 102, ports 105 and an opening 121 and thus establish suitable flows of gas through the drill head 100.

For instance, the example embodiment depicted in FIGS. 1A to 1F and FIG. 2 shows an assembly of multiple components for constructing the drill head 100, and such a configuration may be convenient from a manufacturing perspective. However, it will be understood that the use of an assembly of components as shown is not essential, and it is possible to construct a suitable drill head 100 from an assembly of fewer components or even as a single part integrating the required features, such as by utilising 3D printing or additive manufacturing techniques, or the like.

Furthermore, the specific arrangement of the passageways 101, 102, ports 105 and the opening 121 as depicted in the Figures is not essential. For instance, it will be appreciated that the relative positioning of the passageways 101, 102 and the ports 105 providing for gas flow therebetween does not need to be as shown, although as discussed below there may be certain structural and functional advantages for using the depicted arrangement. Whilst some examples of alternative arrangements will be mentioned in the discussion of the construction of depicted embodiment, it should be understood that other variations which nevertheless provide the above described basic functionality are possible, even if these are not explicitly discussed.

Further preferred and/or optional features of the drill head 100 will now be described with reference to the Figures. As discussed above, it should be noted that whilst the particular embodiment shown in the Figures illustrates a preferred drill head 100 configuration, different configurations may also be suitably employed to provide the above described functionality and at least some of the features to be outlined below.

Typically, the supply passageway 101 will define a supply cross section area and the return passageway 102 will define a return cross section area, as can be best seen in the end view of FIG. 1B. Each of the passageways 101, 102 may be defined such that their respective cross section areas are substantially constant along at least a portion of their length, to thereby allow for stable flow of gas through each of the passageways 101, 102.

In some examples, the supply passageway 101 and the return passageway 102 may be configured so that the supply cross section area is greater than the return cross section area. It will be understood that these different cross section areas will result in the flow of gas in the respective passageways 101, 102 having different pressures and velocities. In particular, when the supply cross section area is greater than the return cross section area, the flow of gas in the return passageway 102 will have a greater velocity and a reduced pressure compared to the flow of gas in the supply passageway 101. Accordingly, the supply cross section area and the return cross section area can be selected to provide a pressure reduction between the supply passageway 101 and the return passageway 102, due to the venturi effect. The design of the drill head 100 may thus take advantage of this pressure differential due to the venturi effect draw loose material 203 into the opening 121 and in turn through the return passageway 102.

In preferred embodiments, the one of more ports 105 will be configured to direct the flow of gas into the return passageway 102 in a manner which further assists in drawing loose material 203 into the return passageway 102. Typically this is achieved by having the ports direct the flow of gas in a particular direction relative to the return passageway 102, for establishing preferable flow conditions within the return passageway 102.

In most examples, the one or more ports 105 will usually be configured so that the at least some of the flow of gas directed into the return passageway 102 includes an axial flow component relative to an axis of the return passageway 102. It will be understood that this will aid in establishing the flow of gas through the return passageway 102 in the flow direction extending away from the base 120 and towards the inner tube 170, for transporting loose material 203 entrained within the flow of gas to the surface.

However, it may also be desirable to configure the ports 105 so that the flow of gas directed into the return passageway 102 further includes a rotational flow component relative to the axis of the return passageway 102. This may be achieved, for example, by having the ports 105 oriented at an angle relative to the axis of the return passageway 102. The particular orientation angle may be selected to control the amount of rotational flow in the flow of gas directed into the return passageway 102. In rotational drilling arrangements, the orientation angle of the ports 105 may be selected in view of the rotation direction of the drill head 100 in use, so that the rotational flow of the gas in the return passageway 102 can be assisted by the rotation of the drill head 100.

Whilst it is generally convenient to form the ports 105 as straight holes having a particular orientation angle, at least for ease of manufacture, it should be noted that the ports 105 may be formed in other ways, whilst still being capable of directing the flow of gas into the return passageway 102 in a suitable manner. Typically, a portion of each port 105 near its exit into the return passageway 102 will have the greatest influence over the direction of flow entering the return passageway 102 from the ports. Thus, in some examples, the amount of axial and rotational flow may be determined by selection of the exit conditions of the ports 105 without changing the overall orientation of the ports 105.

In some examples, the ports 105 may be configured so that the flow of gas directed into the return passageway 102 forms a vortical flow in at least a portion of the return passageway 102. In other words, the flow of gas may be directed so as to establish a vortex within the return passageway. Those skilled in the art will understand that the vortical flow will usually have a reduced pressure in a core region about an axis of the vortex, which can further assist in drawing loose material 203 into the return passageway 102 by suction. Such a vortical flow may be established through appropriate design of the ports 105, and particularly their orientation angle relative to the axis of the return passageway 102 to encourage sufficient rotation in the flow directed into the return passageway 102.

As is the case in this example, the drill head 100 includes a plurality of the ports 105 arranged around the return passageway 102. In this case, eight ports 105 are provided, although different numbers of ports 105 may be used. It will be appreciated that such an arrangement of multiple ports 105 can assist in effectively establishing desirable flow conditions within the return passageway 102 with a reduced transitional flow region as the flow of gas enters the return passageway 102 from the ports 105. Furthermore, a suitable number of ports 105 evenly arranged around the return passageway 102 can help to induce a rotational or vortical flow within the return passageway 102, if required.

It will be appreciated that as the flow of gas is directed from the supply passageway 101 into the return passageway 102 via the ports 105, some gas may be drawn from the region proximate to the cutting face 202 into the opening 121 and through the return passageway 102, along with the loose material 203, as indicated in FIG. 2 by arrow 216. In some examples, additional gas may flow from the surface through the annular gap 220 between the sidewalls 204 of the drilled hole and the housing 110 and the drill pipe 260, as indicated by arrows 221, and subsequently drawn into the opening 121. This flow of additional gas can also beneficially sweep the cutting face 202 to help to collect loose materials 203 to be drawn into the opening 121.

However, in some circumstances such a flow of additional gas can be undesirable as it may result in contamination of the loose material 203 from the cutting face 202 with other materials from higher in the drilled hole. Accordingly, in some embodiments, the drill head 100 may further include one or more holes 107 through the base 120 for allowing some of the flow of gas to pass from the supply passageway 101 to a region proximate to the one or more drill cutters 130. Examples of these holes 107 can be seen in FIGS. 1D and 1F and FIG. 2.

With regard to FIG. 2, it will be seen that the holes 107 are formed to receive gas from the supply passageway 101 such that some of the flow of gas supplied to the supply passageway 101 can flow through the holes 107 rather than through the ports 105 into the return passageway 102. The gas flowing through the holes 107 will exit through the base 120 near the drill cutters 130 as indicated by arrows 218, to blow onto the cutting face 202. This gas flow can beneficially sweep the cutting face 202 as indicated by arrows 219 so that loose materials 203 can be more effectively drawn into the opening 121.

In other words, the holes 107 effectively allow some of the flow of gas supplied to the supply passageway 101 to bypass the ports 105 and instead pass directly to the region proximate to the drill cutters 130. As a result, the gas flowing through the holes 107 is able to sweep the cutting face 202 formed by the drill cutters 130 in use prior to being drawn back into the opening 121 with loose material 203.

Although a similar effect may be achieved by allowing an additional flow of gas from the surface to enter the opening 121 as mentioned above, the use of the holes 107 to supply the gas for sweeping the cutting face 202 may remove or at least significantly reduce the need for gas to flow from the surface, thus reducing or eliminating contamination of the rock chip samples by material from higher parts of the drill hole.

In this example, the drill head 100 includes a plurality of the holes 107 arranged around the opening 121 in the base 120. It will generally be preferable to provide a number of evenly spaced holes 107 around the opening 120 to allow for desirable flow conditions across the cutting face 202. It will be appreciated that the number and spacing of the holes 107 may be dictated to at least some extent by the arrangement of drill cutters 130 attached to the base 120. In this example, four drill cutters 130 are attached to the base 120, and correspondingly, four holes 107 are provided, each for allowing gas to flow between adjacent drill cutters 130.

The relative amount of gas flowing through the ports 105 and through the holes 107 may be controlled by selecting the total number of and sizes of the ports 105 and the holes 107. For example, a greater proportion of flow can be directed through the ports 105 by ensuring the holes 107 are smaller than the ports 105 and/or by providing fewer holes 107 than ports 105.

In any event, it will be appreciated that allowing for some of the flow of gas from the supply passageway to bypass the ports 105 and sweep the cutting face 202 before being drawn into the opening 121 and rejoining the rest of the flow of gas directed into the return passageway 102 via the ports 105 can assist in removing loose material 203 from the cutting face 202 and improve the quality of rock chip samples returned to the surface.

Further details of the structural configuration of the example drill head 100 shown in the Figures will now be described.

In this example, the housing 110 has a generally cylindrical shape and the return passageway 102 is located coaxially inside the housing 110. It will be appreciated that a cylindrical housing 110 will allow for convenient attachment of the first end 111 of the housing 110 to a cylindrical drill pipe 260, such as by using a threaded portion 113 provided on the outside of the first end of 111 of the housing 110. Furthermore, a cylindrical housing 110 can be conveniently manufactured using a lathe or the like.

The supply passageway 101 may be located between the return passageway 102 and an outside surface of the housing 110. In other words, the return passageway 102 may extend through the centre of the housing and the supply passageway 101 may be offset from the centre. In the depicted embodiment, the supply passageway 101 is provided as an annular passageway, and the return passageway 102 is located concentrically inside the annular supply passageway 101. It will be appreciated that this allows for an axi-symmetrical arrangement of the passageways 101, 102, which can be particularly advantageous for rotational drilling where imbalanced masses due to asymmetry could result in undesirable vibrations. Moreover, as will be discussed below, this arrangement can facilitate the use of a straightforward multi-component construction for forming the drill head 110.

For example, the drill head 100 may include a hollow outer housing 140 and an inner housing 150 positioned inside the outer housing 110, with the return passageway 102 being defined within the inner housing 150 and the supply passageway 101 being defined between the inner housing 150 and the outer housing 140. In the depicted example, the outer housing 140 is provided by an outer housing component 140 and the inner housing 150 is provided by an inner housing component 150. As can be best seen in FIGS. 1E and 1F, the outer housing component 140 and the inner housing component 150 may each be formed as generally cylindrical bodies with open ends.

Figure 3A:
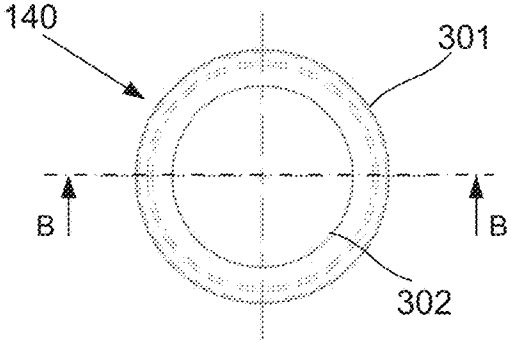
FIG. 3A is an end view of an outer housing component of the drill head of FIG. 1F.
Figure 3C:
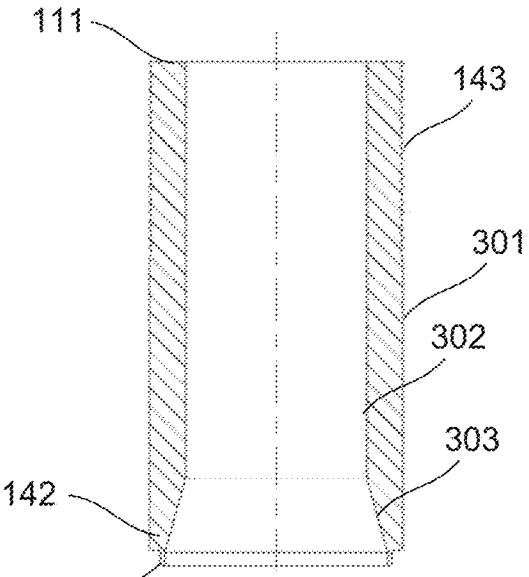
FIG. 3C is a side cross-section view of the outer housing component at section B-B of FIG. 3B.
Figure 3B:
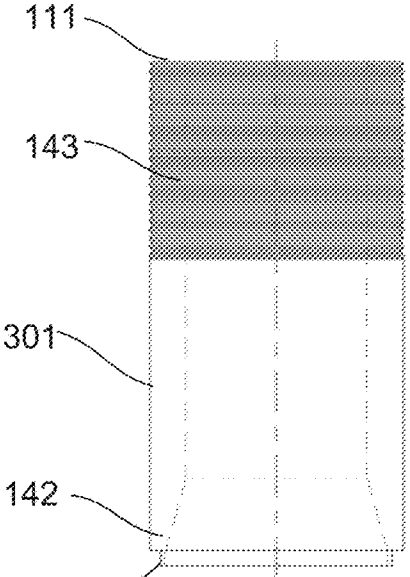
FIG. 3B is a side view of the outer housing component of FIG. 3A.
Figure 5A:
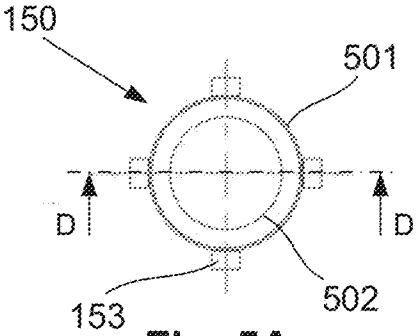
FIG. 5A is an end view of an inner housing component of the drill head of FIG. 1F.
Figure 5B:
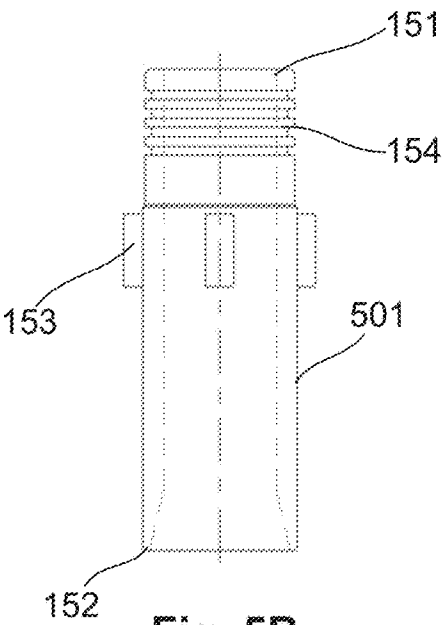
FIG. 5B is a side view of the inner housing component of FIG. 5A.
Figure 5C:
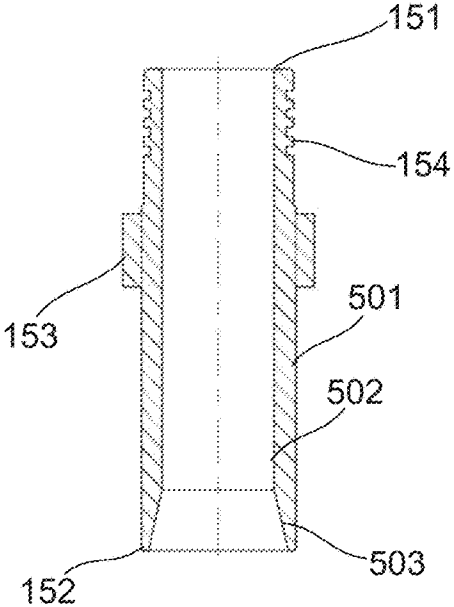
FIG. 5C is a side cross-section view of the inner housing component at section C-C of FIG. 5B.

Further details of the outer housing component 140 are shown in FIGS. 3A to 3C, where it can be seen that the outer housing component 150 includes an outer wall 301 and a central bore defining an inner wall 302. The inner housing component 150 is located inside of the central bore of the outer housing component 140. Further details of the inner housing component 150 are shown in FIGS. 5A to 5C, where it can be seen that the inner housing component 150 has its own outer wall 501 and its own central bore defining an inner wall 501. The central bore of the inner housing component 150 forms a main portion of the return passageway 102. The supply passageway 101 is formed between the outer wall 501 of the inner housing component 150 and the inner wall 301 of the outer housing component 140.

In this example, the inner housing component 150 includes one or more spacers 153 for locating the inner housing component 140 relative to the outer housing component 150. The spacers 153 will typically protrude outwardly from the outer wall 501 of the inner housing component 150, and be configured to engage with the inner wall 302 of the outer housing component 140, to thereby radially locate the inner housing component 150 within the bore of the outer housing component 140, whilst allowing gas to flow around the spacers 153 without substantially restricting the overall flow of gas through the supply passageway 101. In this case, four spacers 153 are arranged evenly around the inner housing component 150.

Turning back to the views of the outer housing component 140 in FIGS. 3A to 3C, it will be seen that the outer housing component 140 includes a threaded portion 143 which is configured for allowing the outer housing component 140, and thus the assembly of components forming the drill head 100, to be threadingly connected to the drill pipe 260 as shown in FIG. 2. Such a threaded connection will be suitable for transferring rotary drilling loads from the drill pipe 260 to the drill head 100, whilst also providing a sealed connection suitable for allowing the gas flow to be supplied into the supply passageway 101 formed inside the outer housing component 140.

With regard to the views of the inner housing component 150 in FIGS. 5A to 5C, it can be seen that in this case, a series of grooves 154 are formed at a first end 151 of the inner housing component 150. As shown in FIG. 2, o-rings 271 may be placed into the grooves 154 to assist in sealing a connection between the inner tube 270 and the inner housing component 150, where the inner tube 270 is push fit onto the first end 151 of the inner housing component 150.

However, it will be appreciated that different techniques may be used for connecting the outer housing component 140 to the drill pipe 260 and for connecting the inner housing component 150 to the inner tube 270 extending inside the drill pipe 260, provided these are capable of transferring any required loads, such as drilling loads, and also allow for the required gas glows into the respective passageways 101, 102.

In the depicted example, the ports 105 are provided in a port component 160 connected to a second end 152 of the inner housing component 150. Providing the ports 105 in a separate port component 160 in this manner can have several advantages. For instance, different port component 160 configurations may be provided by simply exchanging the port component 160 with another port component 160 with a different arrangement of ports 105. Furthermore, the use of a separate port component 160 can allow for more straightforward manufacture rather than having the ports 105 formed, for instance, in the second end 152 of the inner housing component 150. Nevertheless, it will be understood that it will be possible to integrate the port component 160 and the inner housing component 150 to reduce the number of components and amount of assembly, typically at the expense of more complex manufacturing requirements.

As can be best seen in FIGS. 1E and 1F, the port component 160 may be configured to be connected between the inner housing component 150 and the base 120. The port component 160 will typically include a central aperture for extending the return passageway 102 in the inner housing component 150 to the opening 121 in the base 120. In this example, the base 120 is provided by a further base component 170 connected to the second end 142 of the outer housing component 140. The base component 170 will typically include the opening 121 and be configured to allow the attachment of the drill cutters 130. In this case, the base component 170 defines drill cutter receptacles 174 for receiving attachment portions of the drill cutters 130, which can be welded or otherwise fastened to the base component 170.

Figure 4A:
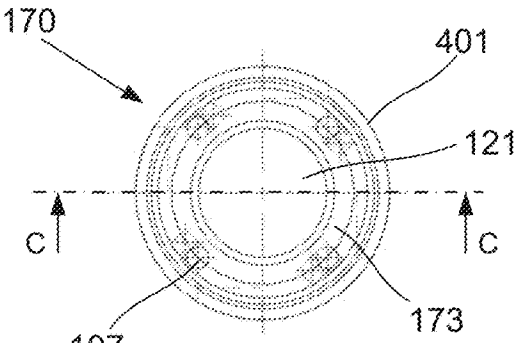
FIG. 4A is an end view of a base component of the drill head of FIG. 1F.
Figure 4B:
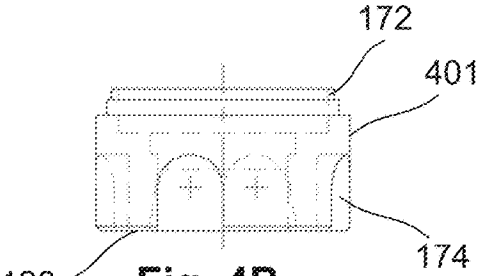
FIG. 4B is a side view of the base component of FIG. 4A.
Figure 4C:
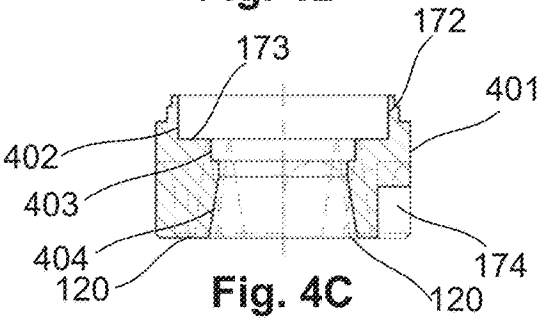
FIG. 4C is a side cross-section view of the base component at section C-C of FIG. 4B.

Further details of the base component 170 can be seen in FIGS. 4A to 4C. The base component 170 may be formed as a cylindrical body having an outer wall 401 with an outside diameter generally corresponding to an outside diameter of the outer wall 301 of the outer housing component 140. In this example, the base component 170 includes a lip 172 configured to engage with a corresponding lip 144 at the second end 142 of the outer housing component. These lips 172, 144 may be connected by welding or any other suitable connection technique to thereby join the base component 170 to the outer housing component 140.

The internal details of the base component 170 can be seen in isolation in FIG. 4C and in the context of the assembly in FIGS. 1D and 1E and FIG. 2. The base component 170 has a central shaft having varying dimensions, which each have different functions. A first shaft portion having an enlarged diameter extends from the lip 172 into the base component 170 and defines a first inner wall 402 and ends at a step 173.

As can be seen in FIG. 1D, the port component 160 is positioned partially inside the first shaft portion, and as shown in FIG. 2, the ports 105 receive a flow of gas from an annular region 106 between the port component 160 and the first inner wall 402 of the base component 170.

The holes 107 extend from the step 173 through to the base 120, and also receive a flow of gas from the same annular region 106 as the ports 105. The holes 107 and the ports 105 may be staggered relative to one another to ensure even distribution of gas supplied along the supply passageway 101 through the ports 105 and the holes 107. It is noted that the outer housing component 140 includes a flared inner wall portion 303 as indicated in FIG. 3C, which helps to accommodate the port component 160 and direct the supplied flow of gas into the annular region 106 for distribution in to the ports 105 and the holes 107.

As shown in the hidden details in FIGS. 4A and 4C, the holes 107 in the base component 170 may be angled relative to a central axis of the base component 170, which can provide for a rotational component in the flow of gas that bypasses the ports 105 and is directed via the holes 107 into the region proximate to the drill cutters 130.

The base component 170 includes a second shaft portion extending from the first shaft portion and defining a second inner wall 403 having a reduced internal diameter relative to the first inner wall 402. The second shaft portion receives a second end 162 of the port component 160 when the drill head 100 is assembled. Finally, a third shaft portion extends through the remainder of the base component 160 and defines a third inner wall 404, which in this case is flared outwardly to the opening 121.

Figure 6A:
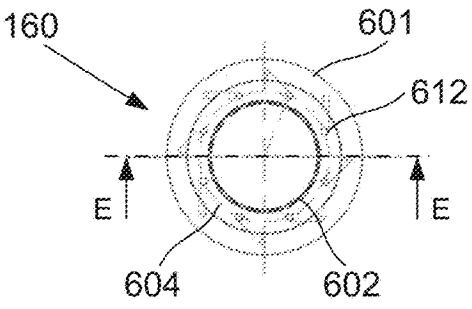
FIG. 6A is an end view of a port component of the drill head of FIG. 1F.
Figure 6B:
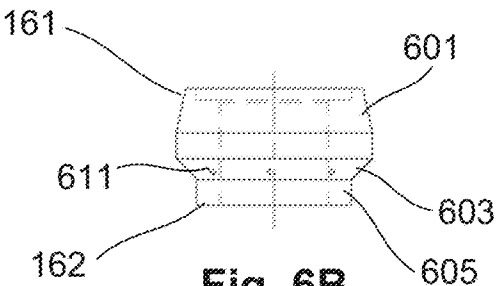
FIG. 6B is a side view of the port component of FIG. 6A.
Figure 6C:
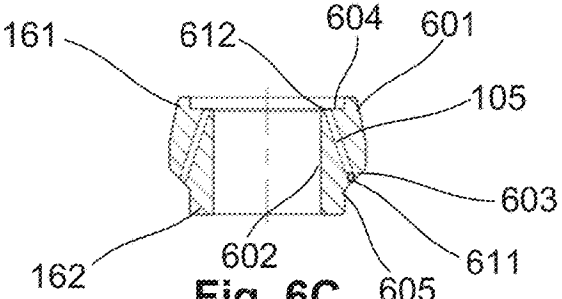
FIG. 6C is a side cross-section view of the port component at section D-D of FIG. 6B.

Turning to FIGS. 6A to 6C, it can be seen that the port component 160 has different outer surfaces. The port component 160 includes a first outer surface 601 which generally matches the angle of the flared inner wall portion 303 of the outer housing component 140 so as to allow the flow of gas from the supply passageway 101 to pass around the port component 160 without substantial flow restrictions. The ports 105 are formed in a second outer surface 603 which provides entry points 611 for the port 105 to allow gas flow from the supply passageway 101 into the ports 105 from the annular region 106 discussed above.

A third outer surface 605 extends from the second outer surface 603 to the second end 162 of the port component 160. This third outer surface 605 is configured to be received inside the second shaft portion of the base component 170 and mate with its second inner wall 403. The second end 162 of the port component 160 will rest on a shoulder region between the second inner wall 403 and the third inner wall 404 of the base component 170.

With regard to the internal features of the port component 160 as shown in FIG. 6C, it will be seen that the central aperture extending through the port component 160 forms a generally straight internal wall 602. An enlarged internal shelf 604 is defined in the first end 161 of the port component 160, and this provides exit points 612 for the ports 105.

As can be seen in the internal views of the drill head 100 assembly in FIGS. 1D and 1E, the second end 152 of the inner housing component 150 will engage with the internal shelf 604 of the port component. It is noted that the inner housing component 150 has a flared inner wall portion 503 as indicated in FIG. 5C, and this helps to prevent obstruction of the exit points 612 of the ports 105 and thus permit the flow of gas from the ports 105 into the return passageway 102.

It will be appreciated that each of the above described components in the assembly of the drill head 100 can be easily formed from suitable materials such as steel, other metals, ceramics or the like using conventional manufacturing techniques including casting, lathing, machining and drilling. However, the features described above do not need to be provided in separate components as per the depicted example, and may be provided in different components or integrated into fewer components without compromising the functionality of the drill head 100.

For example, the inner housing component 150 and the port component 160 may be easily integrated into a single component including suitable ports 105 whilst still being capable of manufacture using conventional techniques. In an example of complete integration, 3D printing or additive manufacture techniques may be used to form the drill head 100 as a unitary body with all required passageways 101, 102, ports 105 and the opening 121.

Accordingly, there is substantial design flexibility in the specific construction of the drill head 100, such that a range of different configurations may be implemented whilst still providing a functional drill head providing improvements over conventional air drilling techniques as outlined above.

As mentioned above, the drill head 100 may alternatively be used in a hammer drilling configuration where suitably adapted drill cutters 130 are driven periodically by a pneumatic motor rather than by rotation of the drill pipe 260.

In one example, a hammer drilling module may be connected between the drill pipe 260 and the drill head 100, for driving the drill head 100 and attached drill cutters 130. In this case, the pneumatic motor may be supplied with some of the compressed gas flowing through the drill pipe 260 before it reaches the supply passageway 101 within the drill head 100.

In summary, the internally defined passageways 101, 102 and particularly the use of the ports 105 to direct at least some of the flow of gas from the supply passageway 101 into the return passageway 102 will tend to create positive suction for drawing samples into the return passageway 102 for transport to the surface via the inner tube 270.

The suction created also causes any other flow of gas (such as gas bypassing the ports 105 and flowing through the optional holes 107) being used to flush loose material 203 such as rock chips from the cutting face 202 to flow into the return passageway 102 and in turn into the inner tube 270. Greater sample weights can be collected in reduced timeframes using this approach.

It will be appreciated that as the volume and pressure of the flow of gas supplied into the supply passageway 101 is increased, the above discussed suction effect will correspondingly increase, aiding in sample recovery and the ability to use increased air pressure compared to traditional air drilling arrangements, where excessive air pressure may undesirable force loose material onto the cutting face 202.

Accordingly, suitable embodiments of the drill head 100 may effectively provide for an improved scavenging effect which allows for a cleaner drill hole compared to conventional air drilling arrangements. The resulting cleaner drill hole and more rapid sample removal due to this scavenging effect can also allow for a greater rate of penetration. The cleaner drill hole also reduces the chance of the drill pipe 260 becoming stuck in the hole.

Throughout this specification and claims which follow, unless the context requires otherwise, the word "comprise", and variations such as "comprises" or "comprising", will be understood to imply the inclusion of a stated integer or group of integers or steps but not the exclusion of any other integer or group of integers.

Persons skilled in the art will appreciate that numerous variations and modifications will become apparent. All such variations and modifications which become apparent to persons skilled in the art, should be considered to fall within the spirit and scope that the invention broadly appearing before described.

The claims defining the invention are as follows:

1. A drill head including:

a) an elongate housing, a first end of the housing being coupled to an end of a drill pipe in use;

b) a base at a second end of the housing, one or more drill cutters being attached to the base;

c) a supply passageway at least partially within the housing, the supply passageway being supplied with a flow of gas in use;

d) a return passageway at least partially within the housing, a first end of the return passageway being connected to an end of an inner tube extending inside the drill pipe in use, and a second end of the return passageway forming an opening in the base proximate to the one or more drill cutters; and, e) one or more ports for directing at least some of the flow of gas from the supply passageway into the return passageway in a flow direction extending away from the base and towards the inner tube, to thereby cause loose material to be drawn into the return passageway through the opening and transported away from the drill head via the inner tube in use, wherein the one or more ports are configured so that the at least some of the flow of gas directed into the return passageway forms a vortical flow in at least a portion of the return passageway, and wherein the vortical flow is established by an orientation angle of the ports relative to the axis of the return passageway, and wherein the vortical flow provides an upwards suction and a rotation of the flow of gas around an axis parallel to a central longitudinal axis of the return passageway.

2. A drill head according to claim 1, wherein the at least some of the flow of gas directed into the return passageway by the one or more ports generates a gas pressure difference between the opening and the return passageway, to thereby cause loose material to be drawn into the return passageway through the opening.

3. A drill head according to claim 1, wherein the supply passageway defines a supply cross section area and the return passageway defines a return cross section area, the supply cross section area being greater than the return cross section area.

4. A drill head according to claim 1, wherein the one or more ports are configured so that the at least some of the flow of gas directed into the return passageway includes an axial flow component relative to an axis of the return passageway.

5. A drill head according to claim 1, wherein the one or more ports are configured so that the at least some of the flow of gas directed into the return passageway further includes a rotational flow component relative to the axis of the return passageway.

6. A drill head according to claim 5, wherein the one or more ports are oriented at an angle relative to the axis of the return passageway.

7. A drill head according to claim 1, wherein the drill head includes a plurality of the ports arranged around the return passageway.

8. A drill head according to claim 1, wherein the drill head includes one or more holes through the base for allowing some of the flow of gas to pass from the supply passageway to a region proximate to the one or more drill cutters.

9. A drill head according to claim 8, wherein the drill head includes a plurality of the holes arranged around the opening in the base.

10. A drill head according to claim 1, wherein the housing has a generally cylindrical shape and the return passageway is located coaxially inside the housing.

11. A drill head according to claim 1, wherein the supply passageway is located between the return passageway and an outside surface of the housing.

12. A drill head according to claim 11, wherein the supply passageway is provided as an annular passageway, the return passageway being located concentrically inside the annular supply passageway.

13. A drill head according to claim 1, wherein the drill head includes a hollow outer housing and an inner housing positioned inside the outer housing, the return passageway being defined within the inner housing and the supply passageway being defined between the inner housing and the outer housing.

14. A drill head according to claim 13, wherein the outer housing is provided by an outer housing component and the inner housing is provided by an inner housing component.

15. A drill head according to claim 14, wherein the inner housing component includes one or more spacers for locating the inner housing component relative to the outer housing component.

16. A drill head according to claim 1, wherein the one or more ports are provided in a port component connected to an end of the inner housing component.

17. A drill head according to claim 16, wherein the port component is configured to be connected between the inner housing component and the base.

18. A drill head according to claim 16, wherein the port component includes a central aperture for extending the return passageway in the inner housing component to the opening in the base.

19. A drill head according to claim 1, wherein the base is provided by a base component connected to an end of the outer housing component, the base component including the opening and being configured to allow the attachment of the one or more drill cutters.

20. A drill head according to claim 1, wherein the vortical flow has a reduced pressure in a core region about an axis of the vertical flow to assist in drawing loose material into the return passageway.

* * * * *